US008292470B2

(12) United States Patent
Liao

(10) Patent No.: US 8,292,470 B2
(45) Date of Patent: Oct. 23, 2012

(54) FOCUSING MECHANISM FOR LED SPOT LAMP

(75) Inventor: Su-Hsien Liao, Taipei County (TW)

(73) Assignee: Eiko (Pacific) Ltd., Port Louis (MA)

( * ) Notice: Subject to any disclaimer, the term of this patent is extended or adjusted under 35 U.S.C. 154(b) by 246 days.

(21) Appl. No.: 12/845,782

(22) Filed: Jul. 29, 2010

(65) Prior Publication Data

US 2011/0299287 A1 Dec. 8, 2011

(30) Foreign Application Priority Data

Jun. 7, 2010 (TW) ..... 99210813 U

(51) Int. Cl.
*F21V 5/00* (2006.01)

(52) U.S. Cl. ..... 362/311.02; 362/319; 362/326

(58) Field of Classification Search ..... 362/311.02, 362/319, 326, 105, 106
See application file for complete search history.

(56) References Cited

U.S. PATENT DOCUMENTS

| | | | | |
|---|---|---|---|---|
| 5,126,927 | A * | 6/1992 | Reeves et al. | 362/187 |
| 2008/0316733 | A1* | 12/2008 | Spartano et al. | 362/105 |
| 2009/0141500 | A1* | 6/2009 | Peng | 362/294 |
| 2009/0268440 | A1* | 10/2009 | Harnischmacher | 362/187 |
| 2011/0063823 | A1* | 3/2011 | Qiu | 362/188 |
| 2011/0080725 | A1* | 4/2011 | Brands et al. | 362/187 |

* cited by examiner

*Primary Examiner* — Evan Dzierzynski
(74) *Attorney, Agent, or Firm* — CKC & Partners Co., Ltd.

(57) ABSTRACT

A focusing mechanism for LED spot lamp includes a lamp seat and a lens barrel being extendably assembled to the lamp seat. The lamp seat has an LED chip mounted thereon. The lens barrel includes a barrel body having a bottom portion and an opposing top portion, and a lens mounted to the top portion. The bottom portion of the lens barrel is assembled to the lamp seat via an extension coupling structure, such that the lens is located above the LED chip to cover the same. With the extension coupling structure, the lens barrel can be adjusted in position to project from the top of the lamp seat by different distances, so that the focal length between the lens and the LED chip can be regulated to accordingly regulate the focusing and diffusing effects of light emitted from the LED chip.

11 Claims, 4 Drawing Sheets

FOCUSING MECHANISM FOR LED SPOT LAMP

FIELD OF THE INVENTION

The present invention relates to a focusing mechanism, and more particularly to a focusing mechanism for LED spot lamp.

BACKGROUND OF THE INVENTION

A light-emitting diode (LED) has the advantages of small in volume, low power consumption, fast response time, providing colorful lights, and environment-friendly. Therefore, the LED has already become an important light emitting element in people's daily life. For example, the LED can be used as a light emitting element for a spot lamp to form an LED spot lamp.

The LED spot lamp is usually mounted to a fixed position for projecting light on a displayed object. However, the distance between the displayed object and the LED spot lamp is not always fixed while the conventional LED spot lamp has a fixed focal length. In the past, the conventional LED spot lamp is not adjustable in its focal length for emitting light. Thus, it is impossible to adjust the light focusing and light diffusing effects of the LED spot lamp when the same is used to illuminate the displayed object. In brief, the conventional LED spot lamp is inconvenient for use and would therefore result in poor illuminating effect.

SUMMARY OF THE INVENTION

A primary object of the present invention is to provide a focusing mechanism for LED spot lamp, so that a focal length of the LED spot lamp can be adjusted at any time to thereby regulate the light focusing and light diffusing effects of the LED spot lamp on a displayed object being illuminated by the LED spot lamp.

To achieve the above and other objects, the focusing mechanism for LED spot lamp according to an embodiment of the present invention includes a lamp seat having an LED chip mounted thereon, and a lens barrel including a barrel body having a bottom portion and an opposing top portion, and a lens mounted to the top portion. The bottom portion of the lens barrel is assembled to the lamp seat via an extension coupling structure, such that the lens is located above the LED chip to cover the same. With the extension coupling structure, the lens barrel can be adjusted in position to project from the top of the lamp seat by different distances, so that the focal length between the lens and the LED chip can be regulated to accordingly regulate the focusing and diffusing effects of the light emitted from the LED chip.

According to an embodiment of the present invention, the extension coupling structure includes an internal screw thread provided in the lamp seat and an external screw thread provided on an outer wall surface of the bottom portion of the lens barrel; and the external screw thread is adapted to mesh with the internal screw thread, allowing the lens barrel to be screwed into the lamp seat by different depths for regulating the focal length between the lens and the LED chip.

According to an embodiment of the present invention, the internal screw thread provides a screw stroke longer than that provided by the external screw thread, so that the lens barrel can be screwed into the lamp seat by different depths, allowing the lens barrel to project from the lamp seat by different distances.

According to an embodiment of the present invention, the lamp seat is internally provided with an annular recess, so that a raised island portion is formed at a central area of the lamp seat. The LED chip is located on a top of the island portion, the internal screw thread is provided on a radially outer wall surface of the annular recess to space from the island portion, and the barrel body of the lens barrel is extended into the annular recess with the external screw thread meshed with the internal screw thread to enable adjustment of the position of the lens barrel relative to the lamp seat.

According to an embodiment of the present invention, the lamp seat is formed on its top at a position immediately atop the internal screw thread with an annular sunken area, and a retaining ring is fixedly received in the annular sunken area to prevent the lens barrel from moving out of the lamp seat.

According to an embodiment of the present invention, the retaining ring is held to the annular sunken area by means of at least two setting screws.

According to an embodiment of the present invention, the lamp seat is a heat-dissipating lamp seat capable of dissipating heat, so that heat produced by the LED chip during the operation thereof is dissipated into ambient air via the lamp seat.

According to an embodiment of the present invention, the lamp seat is made of an aluminum alloy material to provide a good heat-dissipation effect.

According to an embodiment of the present invention, the lamp seat is provided on an outer wall surface with a plurality of radiating fins to provide increased heat dissipating area and accordingly create enhanced heat-dissipation effect on the LED chip.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
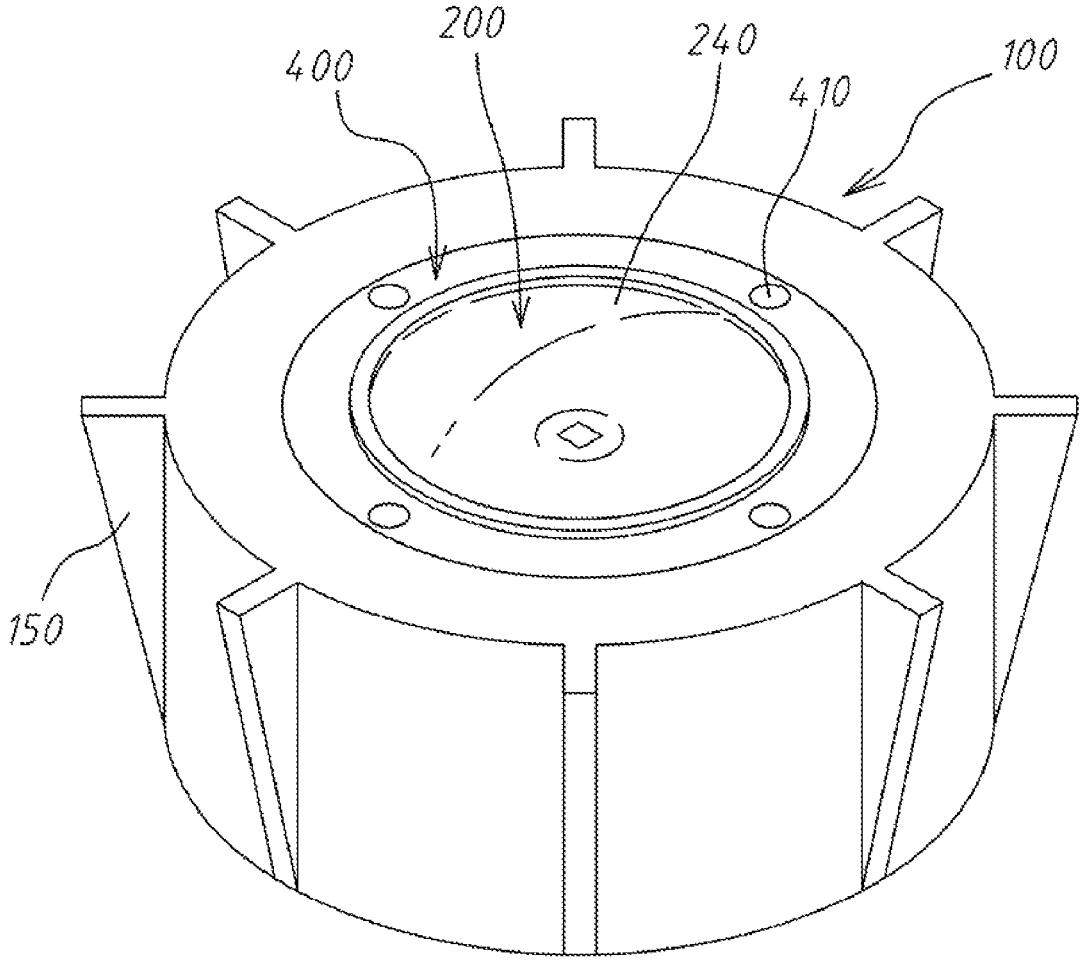
FIG. 1 is a perspective view showing a focusing mechanism for LED spot lamp according to an embodiment of the present invention.
Figure 2:
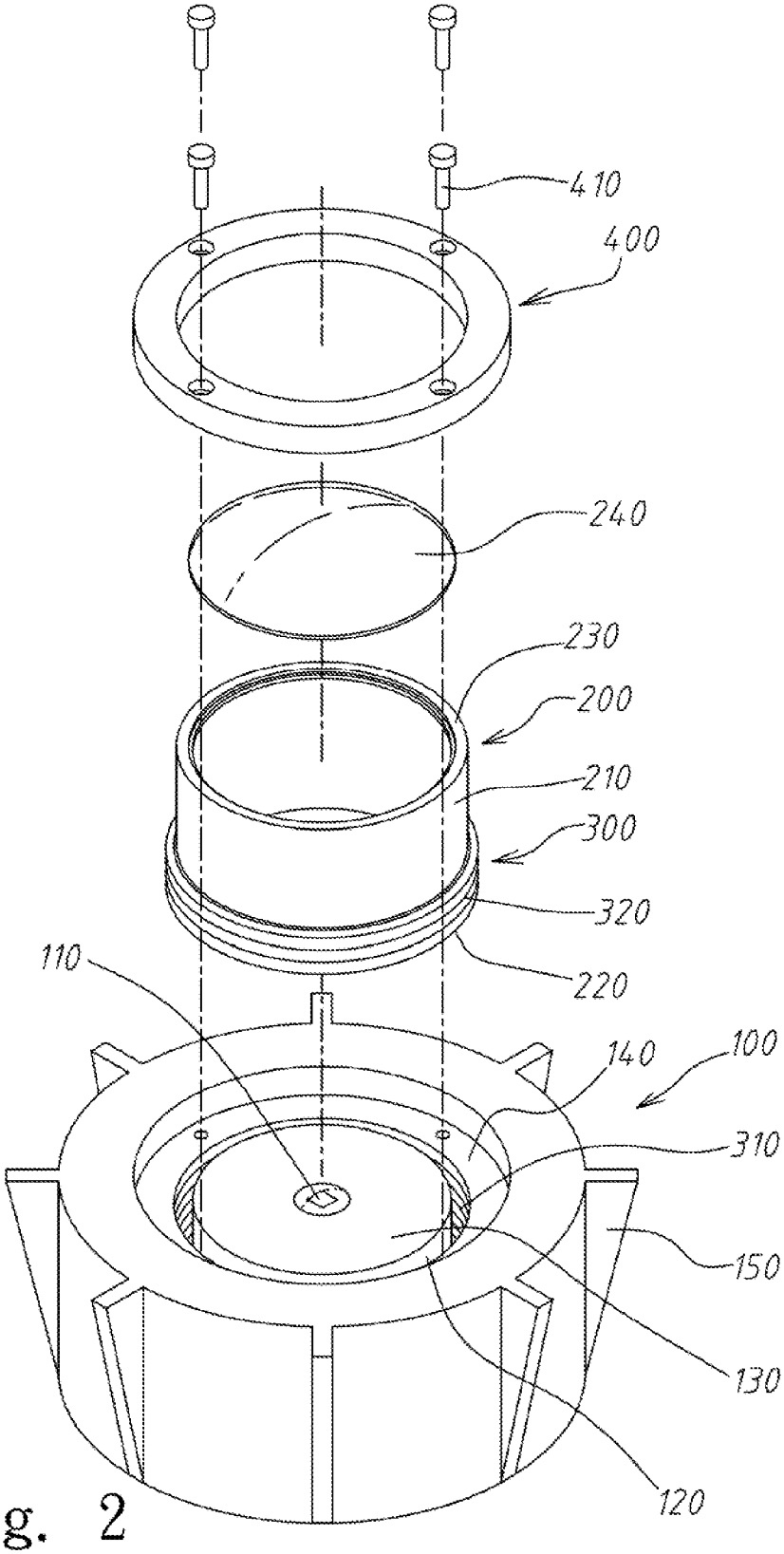
FIG. 2 is an exploded view of FIG. 1.
Figure 3:
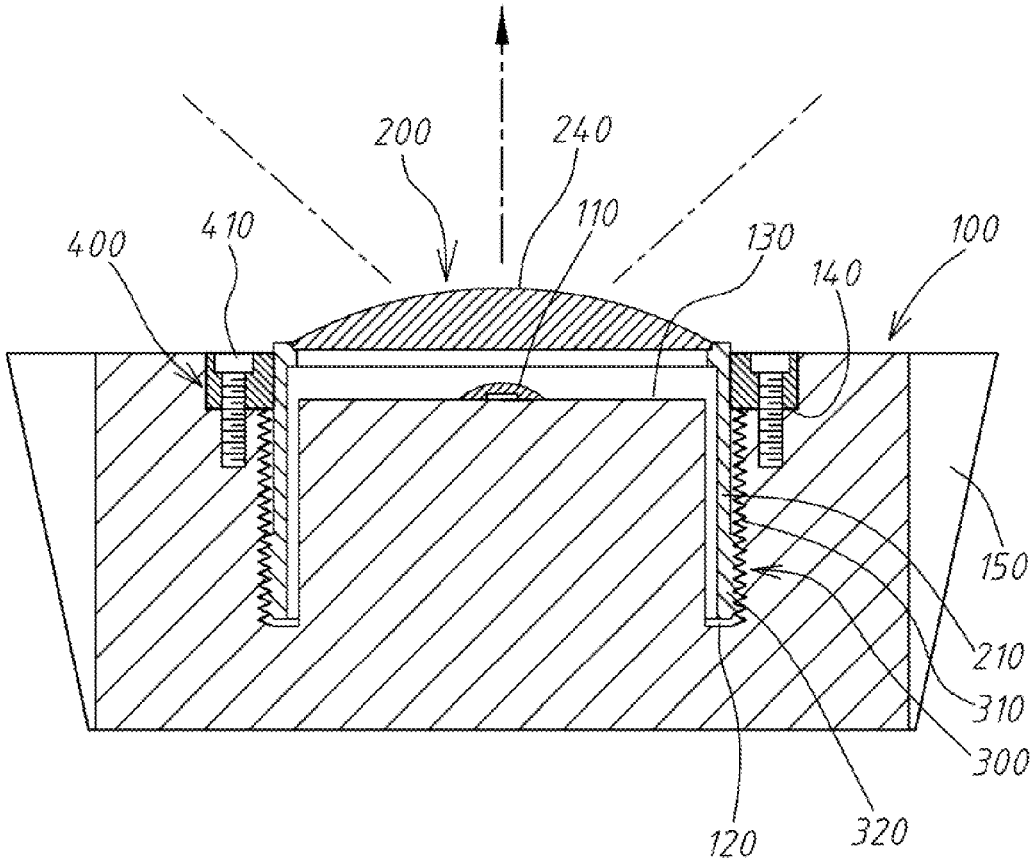
FIG. 3 is a first vertical sectional view of FIG. 1 showing the use of the focusing mechanism of the present invention.
Figure 4:
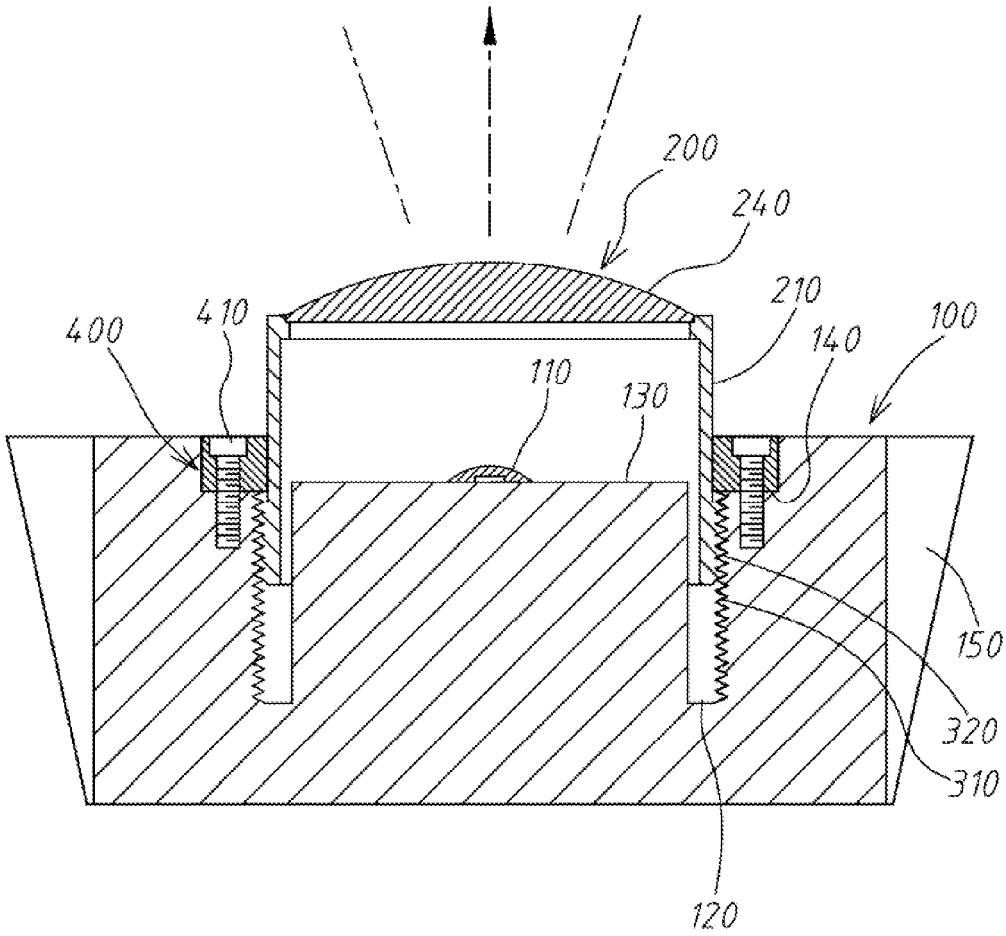
FIG. 4 is a second vertical sectional view of FIG. 1 showing the use of the focusing mechanism of the present invention.

Please refer to FIGS. 1 and 2 that are assembled and exploded perspective views, respectively, showing a focusing mechanism for LED spot lamp according to an embodiment of the present invention; and to FIGS. 3 and 4 that show the use of the focusing mechanism for LED spot lamp according to the present invention.

As shown, the focusing mechanism for LED spot lamp in the illustrated embodiment includes a lamp seat 100 and a lens barrel 200. The lens barrel 200 is assembled to the lamp seat 100 via an extension coupling structure 300, so that the lens barrel 200 is adjustable in position on and relative to a top of the lamp seat 100.

The lamp seat 100 is a heat-dissipating lamp seat capable of providing a heat dissipation effect. For example, the lamp seat 100 can be made of an aluminum alloy material to provide good heat dissipation effect. On the top of the lamp seat 100, there is mounted an LED chip 110 for emitting light outward. Heat produced by the LED chip 110 during the operation thereof can be radiated from the lamp seat 100 to dissipate into ambient air. The lamp seat 100 is further provided on an outer wall surface with a plurality of radiating fins 150 to enable an increased heat dissipation area, so that the LED chip can have improved heat dissipation effect.

The lens barrel 200 includes a barrel body 210 having a bottom portion 220 and an opposing top portion 230. A lens 240 is mounted to the top portion 230 to locate above and cover the LED chip 110. The bottom portion 220 of the lens barrel 200 is assembled to the lamp seat 100 via the extension coupling structure 300.

In implementing the present invention, the extension coupling structure 300 includes an internal screw thread 310 provided in the lamp seat 100 and an external screw thread 320 provided on an outer wall surface of the bottom portion 220 of the lens barrel 200. The internal screw thread 310 provides a screw stroke longer than that provided by the external screw thread 320, allowing the external screw thread 320 to move along the inner screw thread 310 to thereby adjust the lens barrel 200 to different projected positions relative to the lamp seat 100. Further, the lamp seat 100 is internally provided with an annular recess 120, so that a raised island portion 130 is formed at a central area of the lamp seat 100. The internal screw thread 310 is formed on a radially outer wall surface of the annular recess 120 and spaced from the island portion 130. The LED chip 110 is located on a top of the island portion 130. The barrel body 210 of the lens barrel 200 is extended into the annular recess 120 of the lamp seat 100 with the external screw thread 320 meshing with the internal screw thread 310. As can be seen in FIGS. 3 and 4, the lens barrel 200 can be screwed into the annular recess 120 by different depths. By screwing the lens barrel 200 into the annular recess 120 of the lamp seat 100 to different depths, a distance between the lens 240 and the LED chip 110 can be adjusted accordingly. That is, a focal length at which the LED chip 110 can emit light outward via the lens 240 is regulated to thereby adjust the focusing and diffusing effects of the light emitted from the LED chip 110.

Moreover, the lamp seat 100 is formed on its top at a position immediately atop the internal screw thread 310 with an annular sunken area 140. A retaining ring 400 is fitly received in the annular sunken area 140 and tightly held thereto by means of setting screws 410. With the retaining ring 400, the lens barrel 200 is prevented from moving out of the lamp seat 100.

With the focusing mechanism for LED spot lamp according to the present invention, the lens barrel 200 can be easily screwed into the annular recess 120 of the lamp seat 100 to different depths, so that the lens barrel 200 can be projected from the top of the lamp seat 100 by different distances to thereby enable regulation of the focal length between the lens 240 on the lens barrel 200 and the LED chip 110 on the lamp seat 100. In brief, with the focusing mechanism of the present invention, the focusing and diffusing effects of the light emitted from the LED chip 110 can be very conveniently regulated, giving the LED spot lamp good applicability.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A focusing mechanism for LED spot lamp, comprising:

a lamp seat having an LED chip mounted on a top thereof; and a lens barrel including a barrel body having a bottom portion and an opposing top portion, and a lens mounted to the top portion; the bottom portion of the barrel body being assembled to the lamp seat via an extension coupling structure, and the lens being located above the LED chip to cover the same, wherein the extension coupling structure includes an internal screw thread provided in the lamp seat and an external screw thread provided on an outer wall surface of the bottom portion of the lens barrel; and the external screw thread being adapted to mesh with the internal screw thread, allowing the lens barrel to be screwed onto the lamp seat by different depths.

2. The focusing mechanism for LED spot lamp as claimed in claim 1, wherein the internal screw thread provides a screw stroke longer than that provided by the external screw thread.

3. The focusing mechanism for LED spot lamp as claimed in claim 2, wherein the lamp seat is internally provided with an annular recess, so that a raised island portion is formed at a central area of the lamp seat; the LED chip being located on a top of the island portion, the internal screw thread being provided on a radially outer wall surface of the annular recess to space from the island portion, and the barrel body of the lens barrel being extended into the annular recess with the external screw thread meshed with the internal screw thread.

4. The focusing mechanism for LED spot lamp as claimed in claim 3, wherein the lamp seat is formed on its top at a position immediately atop the internal screw thread with an annular sunken area, and a retaining ring is fixedly received in the annular sunken area.

5. The focusing mechanism for LED spot lamp as claimed in claim 4, wherein the retaining ring is held to the annular sunken area by means of at least two setting screws.

6. The focusing mechanism for LED spot lamp as claimed in claim 4, wherein the lamp seat is a heat-dissipating lamp seat capable of dissipating heat transferred thereto.

7. The focusing mechanism for LED spot lamp as claimed in claim 6, wherein the lamp seat is made of an aluminum alloy material.

8. The focusing mechanism for LED spot lamp as claimed in claim 6, wherein the lamp seat is provided on an outer wall surface with a plurality of radiating fins.

9. The focusing mechanism for LED spot lamp as claimed in claim 1, wherein the lamp seat is a heat-dissipating lamp seat capable of dissipating heat transferred thereto.

10. The focusing mechanism for LED spot lamp as claimed in claim 9, wherein the lamp seat is made of aluminum alloy material.

11. The focusing mechanism for LED spot lamp as claimed in claim 9, wherein the lamp seat is provided on an outer wall surface with a plurality of radiating fins.

* * * * *